US005795207A

United States Patent [19]

Blake et al.

[11] Patent Number: 5,795,207

[45] Date of Patent: Aug. 18, 1998

[54] GLASS TO METAL INTERFACE X-RAY TUBE

[75] Inventors: James A. Blake, Franklin; Jamie E. Lazzaro, Wauwatosa, both of Wis.; James R. Dobbs, Niskayna, N.Y.

[73] Assignee: General Electric Company, Milwaukee, Wis.

[21] Appl. No.: 551,091

[22] Filed: Oct. 31, 1995

[51] Int. Cl.[6] ..... H01J 9/26; H01J 9/34

[52] U.S. Cl. ..... 445/28; 445/44; 378/142; 65/42

[58] Field of Search ..... 445/28, 29, 44; 378/142, 141, 139; 65/42

[56] References Cited

U.S. PATENT DOCUMENTS

| | | | |
|---|---|---|---|
| 3,510,925 | 5/1970 | Fleck | 445/29 |
| 4,995,065 | 2/1991 | Janovin et al. | 378/142 |
| 5,384,819 | 1/1995 | Ono | 378/133 |
| 5,541,975 | 7/1996 | Anderson et al. | 378/133 |

FOREIGN PATENT DOCUMENTS

| | | | |
|---|---|---|---|
| 5-290735 | 11/1993 | Japan | 445/28 |

*Primary Examiner*—P. Austin Bradley
*Assistant Examiner*—Jeffrey T. Knapp
*Attorney, Agent, or Firm*—B. Joan Haushalter; John H. Pilarski

[57] ABSTRACT

A method is used for interfacing dissimilar materials in an X-ray tube. The X-ray tube includes a rotor assembly to distribute heat generated in the X-ray tube. The X-ray tube is sealed within a glass material which has a first expansion coefficient. An interface is provided between the rotor assembly and the glass material to absorb temperature coefficient stresses. Preferably, the glass material is Borosilicate and the interface comprises a metal material and a ceramic material. The ceramic material has a second expansion coefficient that closely matches the first expansion coefficient. The metal material is preferably Kovar, and the ceramic material is preferably Mullite. Temperature coefficient stresses are then absorbed within the ceramic and metal structure.

4 Claims, 2 Drawing Sheets

GLASS TO METAL INTERFACE X-RAY TUBE

TECHNICAL FIELD

The present invention relates to vacuum tube devices and, more particularly, to a glass to metal interface X-ray tube construction.

BACKGROUND ART

The X-ray tube has become essential in medical diagnostic imaging, medical therapy, and various medical testing and material analysis industries. Typical X-ray tubes are built with a rotating anode structure for the purpose of distributing the heat generated at the focal spot. The anode is rotated by an induction motor consisting of a cylindrical rotor built into an axle that supports the disc shaped anode target, and an iron stator structure with copper windings that surrounds the elongated neck of the X-ray tube that contains the rotor. The rotor of the rotating anode assembly being driven by the stator which surrounds the rotor of the anode assembly is at anodic potential while the stator is sometimes referenced electrically to ground. The X-ray tube cathode provides a focused electron beam which is accelerated across the anode-to-cathode vacuum gap and produces X-rays upon impact with the anode.

When vacuum tube enclosures are used to surround a mechanical structure such as that found in an X-ray tube, it is always necessary to bond the glass enclosure to some form of metal interface. In the case of the X-ray tube, the glass/metal interface is required to support a rather heavy assembly which includes the motor rotor, the bearing assembly and the massive X-ray target. Additionally, this assembly rotates at high speed, to distribute the heat from X-ray production. Finally, the assembly is cantilevered on the glass/metal interface.

The mechanical and thermal stress on the glass/metal interface and the adjacent glass requires that costly combinations of glass materials be used to accommodate the thermal expansion differences between the Borosilicate type of glass used in the vicinity of the target to the Kovar type alloy material that is used in the glass/metal interface. This temperature coefficient difference is typically accommodated by splicing short tubing sections of different glasses together, thereby making a longer tubing which spreads the thermal stress along its length. The splicing process tends to increase the diametrical tolerance band, preventing the assembly of other components, both internal and external, in close proximity to each other. Composite tube "straightness" is also compromised by the splicing process.

It would be desirable then to have an improved glass to metal interface for X-ray tubes which overcomes the problems associated with the prior art.

SUMMARY OF THE INVENTION

The present invention provides for a glass to metal interface wherein the need to splice the various glass tubings is eliminated. Since thermal stress is accommodated in another component of the assembly, the glass tubing becomes an extension of the Borosilicate bulb and can be drawn, ground polished or otherwise shaped to any dimension and tolerance available to any glass tubing.

In accordance with one aspect of the present invention, a method for interfacing glass and metal in an X-ray tube comprises the steps of providing a ceramic material having an expansion coefficient that closely matches that of the glass, and providing a Kovar material configured to accept the thermal expansion without producing excessive stress on any component parts.

Accordingly, it is an object of the present invention to provide a novel method of interfacing glass and metal, particularly in X-ray tube construction. It is a further object of the present invention to reduce the manufacturing cost of the glass bulb structure inherent in X-ray tube construction. It is yet another object of the present invention to provide more efficient use of vacuum space near the glass/metal interface. Finally, it is an advantage of the present invention that it improves structural integrity of the assembly.

Other objects and advantages of the invention will be apparent from the following description, the accompanying drawings and the appended claims.

DETAILED DESCRIPTION OF THE PREFERRED EMBODIMENTS

The present invention relates to X-ray tubes which employ a rotating anode assembly and a cathode assembly. The purpose of this invention is to improve the method of interfacing glass and metal in the X-ray tube construction.

Figure 1:
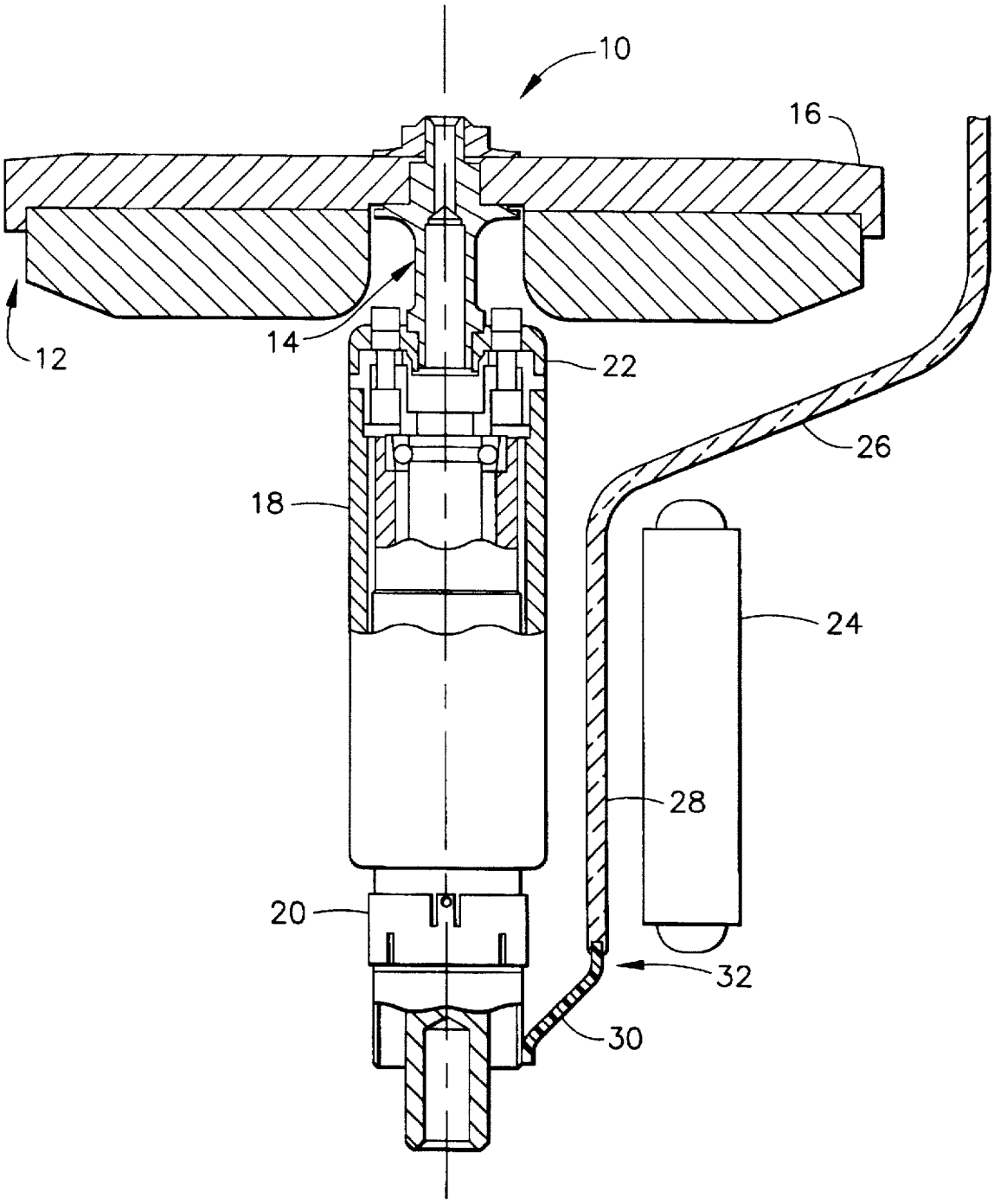
FIG. 1 (PRIOR ART)
FIG. 1 is a prior art cross-sectional illustration of a typical X-ray tube.

Referring now to the drawings, FIG. 1 illustrates a typical prior art X-ray tube 10. The X-ray tube 10 is typically built with a rotating anode assembly 12, with an associated stem 14, for the purpose of distributing the heat generated at a focal spot. The anode assembly 12 comprises a target 16 and a rotor 18, also at anodic potential. A typical X-ray tube 10 further comprises an X-ray tube cathode assembly (not shown) for providing a focused electron beam which is accelerated across a large anode-to-cathode vacuum gap and producing X-rays upon impact with the anode.

Continuing with FIG. 1, the anode assembly 12 is rotated by an induction motor comprising the cylindrical rotor 18 built around a cantilevered axle 20. The cantilevered axle 20 supports the disc shaped anode target 16 connected via a stub and hub 22 to rotor 18 and cantilevered axle 20, which contains bearings facilitating rotation. The rotor 18 of the rotating anode assembly 12, driven by a stator 24 of the induction motor, is at anodic potential while the stator is referenced electrically to ground.

In a typical assembly, a glass bulb or envelope 26, such as Borosilicate or Pyrex, surrounds the rotating anode tube. Stepped glass 28, or rings of varying glass materials melted together, comprise the tube where the gap between a Kovar material 30 and the glass bulb or envelope 26 is bridged. Arrow 32 of FIG. 1 indicates the area where the interface of the present invention is to be implemented.

Figure 2:
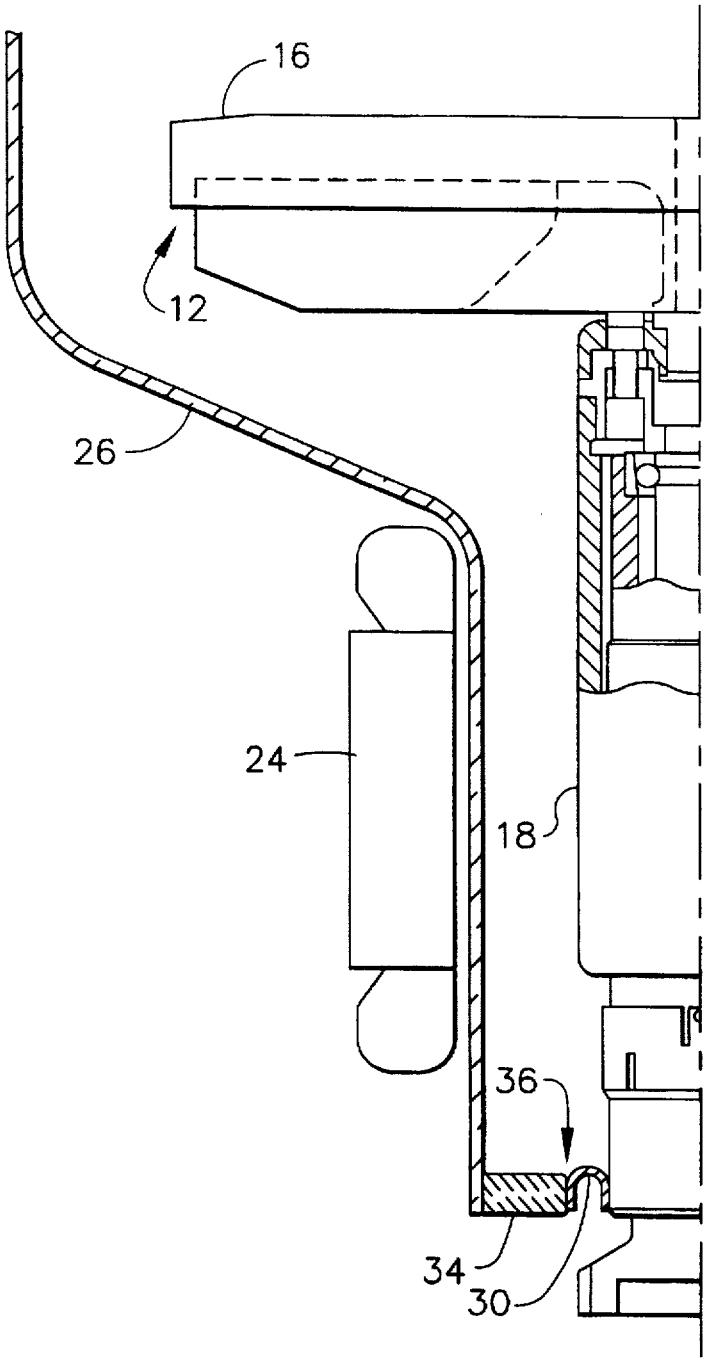
FIG. 2 is a cross-sectional view of an X-ray tube constructed in accordance with the present invention.

Referring now to FIG. 2, the present invention provides for a significant improvement in the interface between the glass and metal components. The mechanical and thermal stress on the glass/metal interface and the adjacent glass has heretofore required that costly combinations of glass materials be used to accommodate the thermal expansion differences between the Borosilicate type of glass used in the vicinity of the target to the Kovar type of metallic material that is used in the glass/metal interface. This temperature coefficient difference has typically been accommodated by splicing short tubing sections of different glasses together making a longer tubing which spreads the thermal stress along its length. The present invention eliminates the need to splice various glass tubing sections.

FIG. 2 illustrates the relationship between the X-ray tube elements. Tubing 26 of the vacuum envelope is shown in the preferred, non-spliced configuration. The minimum spacing between the tubing 26 and the stator 24, and the spacing between the rotor 18 and the tubing 26 is ultimately limited by the thickness and straightness tolerance of the tubing. Motor performance can be improved by reducing this spacing. The present invention employs a ceramic material 34, preferably Mullite, which has an expansion coefficient that closely matches that of the glass material, typically Borosilicate. The cross section of the ceramic part and the associated metallic, i.e., Kovar, portion is configured to accept the thermal expansion without producing excessive stress on any of the component parts. These components are also configured to provide a more convenient use of the vacuum space near the glass/metal interface.

The present invention uses the ceramic material 34 in series with the metallic material 30. This series combination forms the novel interface 36 according to the present invention, which interface is made of different glass materials in the prior art, as shown in FIG. 1. The interface 36 is situated between the rotor assembly and the glass material, which is preferably Borosilicate, such that temperature coefficient stresses are absorbed within the ceramic and metal structure. This, in turn, allows the use of a single temperature coefficient glass for the entire bulb and tubing structure.

In accordance with the present invention, the thermal stress is accommodated in another component of the assembly, i.e., the ceramic 34 and metal 30 interface 36. The glass tubing 26 now becomes an extension of the Borosilicate bulb, minimizing the need for multiple types of glass, Furthermore, the glass tubing can be drawn, ground polished or otherwise shaped to any dimension and tolerance, available for any glass tubing, thereby improving structural integrity of the assembly.

The invention has been described in detail with particular reference to certain preferred embodiments thereof, but it will be understood that modifications and variations can be effected within the spirit and scope of the invention.

What is claimed is:

1. A method for interfacing dissimilar materials in an X-ray tube comprises the steps of:

using a rotor assembly to distribute heat generated in the X-ray tube;

sealing the X-ray tube within a glass material, the glass material having a first expansion coefficient;

providing an interface, the interface comprising a metal material and a ceramic material bridging the glass material and the metal material, the ceramic material having a second expansion coefficient that closely matches the first expansion coefficient, the interface being provided between the rotor assembly and the glass material to absorb temperature coefficient stresses.

2. A method for interfacing dissimilar materials as claimed in claim 1 wherein the glass material comprises Borosilicate.

3. A method for interfacing dissimilar materials as claimed in claim 1 wherein the metal material comprises Kovar.

4. A method for interfacing dissimilar materials as claimed in claim 1 wherein the ceramic material comprises Mullite.

* * * * *